United States Patent [19]

Dehan

[11] Patent Number: 4,886,615

[45] Date of Patent: Dec. 12, 1989

[54] HYDROXY POLYCARBOXYLIC ACID BUILT NON-AQUEOUS LIQUID CLEANING COMPOSITION AND METHOD FOR USE, AND PACKAGE THEREFOR

[75] Inventor: Louis Dehan, Seraing, Belgium

[73] Assignee: Colgate-Palmolive Company, New York, N.Y.

[21] Appl. No.: 171,341

[22] Filed: Mar. 21, 1988

Related U.S. Application Data

[63] Continuation-in-part of Ser. No. 63,199, Jun. 17, 1987, and a continuation-in-part of Ser. No. 830,921, Feb. 19, 1986, Pat. No. 4,767,558, which is a continuation-in-part of Ser. No. 762,165, Aug. 15, 1985, abandoned.

[51] Int. Cl.[4] ..... C11D 17/00; C11D 1/722; C11D 3/395; C11D 3/43

[52] U.S. Cl. ..... 252/90; 252/92; 252/95; 252/99; 252/139; 252/170; 252/174; 252/174.19; 252/174.21; 252/DIG. 14

[58] Field of Search ..... 252/90, 92, 95, 174.19, 252/174.22, 99, 139, 170, 174, DIG. 14

[56] References Cited

U.S. PATENT DOCUMENTS

| | | | |
|---|---|---|---|
| 3,277,009 | 10/1966 | Freifeld et al. | 252/90 |
| 3,671,294 | 6/1972 | Hopermann | 252/90 |
| 4,289,815 | 9/1981 | Lee | 252/90 |
| 4,348,293 | 9/1982 | Clarke et al. | 252/90 |
| 4,622,173 | 11/1986 | Broze et al. | 252/528 |
| 4,647,393 | 2/1987 | Ouhadi et al. | 252/174.19 |
| 4,743,394 | 5/1988 | Kaufmann et al. | 252/90 |

FOREIGN PATENT DOCUMENTS

| | | | |
|---|---|---|---|
| 0249439 | 12/1987 | European Pat. Off. | 252/90 |
| 01078 | 5/1980 | PCT Int'l Appl. | 252/90 |

*Primary Examiner*—Paul Lieberman
*Assistant Examiner*—Kathleen Markowski
*Attorney, Agent, or Firm*—Norman Blumenkopf; Robert C. Sullivan; Murray Grill

[57] ABSTRACT

A package construction for non-aqueous liquid detergent composition includes an outer package of water-permeable, water-insoluble plastic film or textile fabric and an inner package formed of water-soluble material, with an appropriate quantity, e.g. 100 grams, of the non-aqueous liquid composition sealed within the inner bag. A water-impermeable, water-insoluble outer bag or wrapper protects the package and its contents from exposure to moisture or high humidity prior to actual use in the aqueous wash bath. A preferred composition for use with this package construction is a non-aqueous liquid heavy duty no- or low-phosphate built laundry detergent composition which comprises a suspension of hydroxy polycarboxylic acid, e.g. sodium citrate, builder salt in liquid nonionic surfactant. The stability of the composition is improved by the addition of alkylene glycol monoalkyl ether solvents. Stability may be further enhanced by grinding the solid particulate matter, including builder salt, bleach and other minor ingredients to a particle size below about 15 microns. The non-aqueous liquid formulations remain pourable at temperatures as low as about 5° C.

18 Claims, 2 Drawing Sheets

HYDROXY POLYCARBOXYLIC ACID BUILT NON-AQUEOUS LIQUID CLEANING COMPOSITION AND METHOD FOR USE, AND PACKAGE THEREFOR

This application is a continuation-in-part of copending application Ser. No. 063,199, filed June 17, 1987 and is also a continuation-in-part of copending application Ser. No. 830,921, filed Feb. 19, 1986 now U.S. Pat. No. 767,558 which in turn is a continuation-in-part of application Ser. No. 762,165, filed Aug. 15, 1985, now abandoned.

BACKGROUND OF THE INVENTION (1) Field of Invention

This invention relates to non-aqueous liquid fabric treating composition products. More particularly, this invention relates to unitary dispenser packages for low- or no-phosphate, hydroxy polycarboxylic acid salt built non-aqueous liquid laundry detergent compositions which are stable against phase separation and gelation and are easily pourable and to the use of these packaged compositions for cleaning soiled fabrics.

(2) Discussion of Prior Art

Liquid non-aqueous heavy duty laundry detergent compositions are well known in the art. For instance, compositions of that type may comprise a liquid nonionic surfactant in which are dispersed particles of a builder as shown, for instance, in U.S. Pat. Nos. 4,316,812; 3,630,929; 4,254,466; 4,615,820; and 4,661,280.

Liquid detergents are often considered to be more convenient to employ than dry powdered or particulate products and, therefore, have found substantial favor with consumers. They may have one or more of the following advantages: readily measurable; speedily dissolved in the wash water; easily applied in concentrated solutions or dispersions to soiled areas on garments to be laundered; non-dusting; occupy less storage space. Additionally, the liquid detergents may have incorporated in their formulations materials which could not withstand drying operations without deterioration, which materials are often desirably employed in the manufacture of particulate detergent products. Although they are possessed of many advantages over unitary or particulate solid products, liquid detergents often have certain inherent disadvantages, too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

To some extent these problems, particularly as they may be perceived by the consumer, may be partially or completely solved, by incorporating the detergent composition in a unitary package. By "unitary package" is meant a single use disposable package having therein an amount of fabric treating composition appropriate for a single full or partial (e.g. ¼ or ½) load of laundry. For instance, for a unitary package separation of phases may not be so significant since the entire package and content is added to the washing machine.

There have been many proposals in the patent literature for unitary packages for fabric treating compositions, usually for powdery or particulate products, but also for aqueous and non-aqueous liquid formulations. Prepackaged detergent compositions provide several advantages, such as eliminating the need to measure and dispense measured quantities of bulk detergent from a large container, less dusting, less handling of potentially irritating ingredients, such as high alkalinity, bleach components, and so on.

Representative of the art relating to unitary packages for dispersing powdery, liquid or paste fabric treating or other types of compositions in aqueous media mention may be made of U.S. Pat. Nos. 3,186,869; 3,277,009; 3,322,674; 3,528,925; 3,892,905; 4,115,292; 4,348,293; 4,356,099; 4,416,791; 4,608,187; 4,610,799; 4,626,372 and Canadian Patent 1,112,534.

Clarke, et al., in U.S. Pat. No. 4,348,293, mentioned above, describe a package for powdery detergent comprising an outer water-insoluble, water-permeable bag and a water-soluble or dispersible protective inner layer. The package may be in the form of a laminate or as separate sheets, properly folded to encase the powdery detergent. The protective inner layer being essentially non-porous, avoids dusting of the powder composition during the bag filling operation and during use of the package.

For liquid detergent formulations, e.g. suspensions of detergent builder particles in liquid nonionic surfactant, although dusting may not be a problem, nevertheless the liquid phase of the composition, especially for liquid formulations of relatively low viscosity, e.g. below about 10,000 centipoise, may leak through the protective inner layer or through any imperfectly formed seams or seals. The same is true, although to a lesser extent, for more viscous liquids, pastes, gels and creams.

It has now been found that the double wall bag construction disclosed by Clarke, et al. may be adapted to any of these pourable low viscosity, high viscosity, paste, gel or cream non-aqueous liquid detergent compositions by proper selection of the material of the water-soluble or dispersible protective inner layer which will avoid leakage of the non-aqueous liquid phase but which will still dissolve or disperse in cold, warm or hot wash water within a reasonably short period of time to release their content into the wash water.

Another potential problem of the Clarke, et al. bag construction is that when the outer water-insoluble, water-permeable bag is sufficiently porous to allow rapid penetration of the wash bath water into the interior of the package to dissolve the inner water-soluble bag and release the detergent composition, if the bag is stored under high humidity conditions, or accidentally comes into contact with water, the inner water-soluble bag may be prematurely dissolved or weakened to allow leakage of the liquid contents. Therefore, in a preferred embodiment of this invention, there is provided a third outermost removable layer of water-insoluble water-impermeable material to protect the package from exposure to or contact with moisture, including atmospheric moisture.

As stated above, by providing the liquid detergent compositions in unitary packages, problem of phase separation, gelling and so on may not be perceived by the consumer and, therefore, may not appear to require special stabilizing systems or other precautions during manufacture. Nevertheless, product stability is an important consideration for the manufacturer since in many cases there may be substantial delays in time between the bulk formulation of the product and the packaging thereof into the unitary doses. Also, the bulk formulations may be made at one location and packaged at a second remote location. In either case, it is important to maintain the product as homogeneous as possible from the time the composition is first formulated until it is filled into the individual packages. It is also important that the physical characteristics of the detergent compositions, such as viscosity, gel formation, agglomeration of suspended solid particles, are not substantially changed or caused to occur over time, such as during storage, shipping or in the course of the filling operation. Any such changes in physical characteristics could seriously adversely impact on the filling operation and filling apparatus and could lead to over or underfilling of the packages, clogging of the filling nozzles or similar problems.

Therefore, in accordance with a preferred embodiment of the invention the non-aqueous heavy duty built laundry detergent composition is formulated with appropriate rheology modifiers, including one or more of viscosity modifiers, antigelling agents and physical stabilizers, in addition to the essential liquid detergent component and suspended solid particles comprising detergent builder salt, particularly hydroxy polycarboxylic acid salt, and other optional functional or aesthetic laundry detergent additives.

The washing power of synthetic nonionic surfactant detergents in laundry detergent compositions can be increased by the addition of builders. Sodium tripolyphosphate is one of the preferred builders. However, the use of polyphosphate builders in detergents does involve several disadvantages such as, for example, the tendency of the polyphosphates to hydrolyse into pyro- and orthophosphates which represent less valuable builders.

In addition, the polyphosphate content of laundry detergents has been blamed for the undesirably high phosphate content of surface water. An increased phosphate content in surface water has been found to contribute towards greater algae growth with the result that the biological equilibrium of the water can be adversely altered.

Recently enacted government legislation has been directed to reducing the amount of polyphosphates present in laundry detergents and in some jurisdictions in which polyphosphates have been a problem to require that the laundry detergents not contain any polyphosphate builders.

Therefore, still further improvements are desired in the stability and performance of built non-aqueous liquid fabric treating compositions and the means for dispensing same in a manner most convenient for consumers.

OBJECTS AND SUMMARY OF INVENTION

Accordingly, it is an object of the invention to provide unitary packages for built non-aqueous liquid fabric treating compositions which are suspensions of insoluble fabric treating particles in a non-aqueous liquid and which are storage stable and dispersible in cold, warm or hot water.

Another object of this invention is to provide unitary packages of no- or low-polyphosphate highly built heavy duty non-aqueous liquid nonionic surfactant laundry detergent compositions which resist settling of the suspended solid particles or separation of the liquid phase.

It is also an object of this invention to provide unitary packages with non-aqueous liquid detergent compositions which are freely flowing and easily pourable, even at temperatures of 5° C or lower, and which are readily filled into a double wall sachet package having a water-insoluble, water permeable outer layer and a water-soluble or dispersible liquid impermeable protective inner layer.

Still another object of this invention is to provide a disposable single use double wall sachet package for a non-aqueous liquid laundry detergent composition which package is inexpensive in construction and which includes a waterproof outermost layer to protect the package from premature exposure to moisture or dirt.

These and other objects of this invention which will become more apparent from the following detailed description and preferred embodiments are provided by a detergent product which comprises a double wall sachet including a water-soluble liquid impermeable inner layer surrounding a non-aqueous liquid detergent composition and a water-insoluble, water-permeable bag surrounding the inner layer, the liquid detergent composition comprising a no- or low-phosphorus non-aqueous liquid laundry detergent composition which includes a non-aqueous liquid composed of nonionic liquid surfactant, fabric treating solid particles suspended in the non-aqueous liquid, and an amount effective to reduce the product's viscosity and lower its gelling temperature of an alkylene glycol monoalkyl ether solvent, wherein at least 50% by weight of the fabric treating solid particles are comprised of a salt of hydroxy polycarboxylic acid as detergent builder.

Accordingly, in one aspect the present invention provides a detergent product comprising a liquid heavy duty laundry composition composed of hydroxy polycarboxylic acid detergent builder salt in a liquid nonionic surfactant and an alkylene glycol alkyl ether solvent in an amount to make the suspension pourable even at temperatures as low as 5° C or below, the liquid composition being packaged in a sachet comprising a closed water-insoluble, water-permeable outer bag and an inner layer of a water-soluble liquid impermeable material separating the liquid composition from the outer bag.

According to another aspect, the invention provides a single use disposable package for dispensing a non-aqueous built liquid laundry detergent composition wherein the package comprises a multicomponent sachet including an outer bag fabricated from water-insoluble, water-permeable non-woven fabric, an inner bag fabricated from a film of water-soluble or dispersible, liquid impermeable material which is heat-sealable at least along the outer edges, and surrounding the outer bag, a removable envelope of water-insoluble water-impermeable material to protect the water-soluble inner bag from exposure to or contact with moisture and dirt prior to adding the sachet, to an aqueous wash bath.

DETAILED DESCRIPTION OF INVENTION AND PREFERRED EMBODIMENTS

Figure 1:
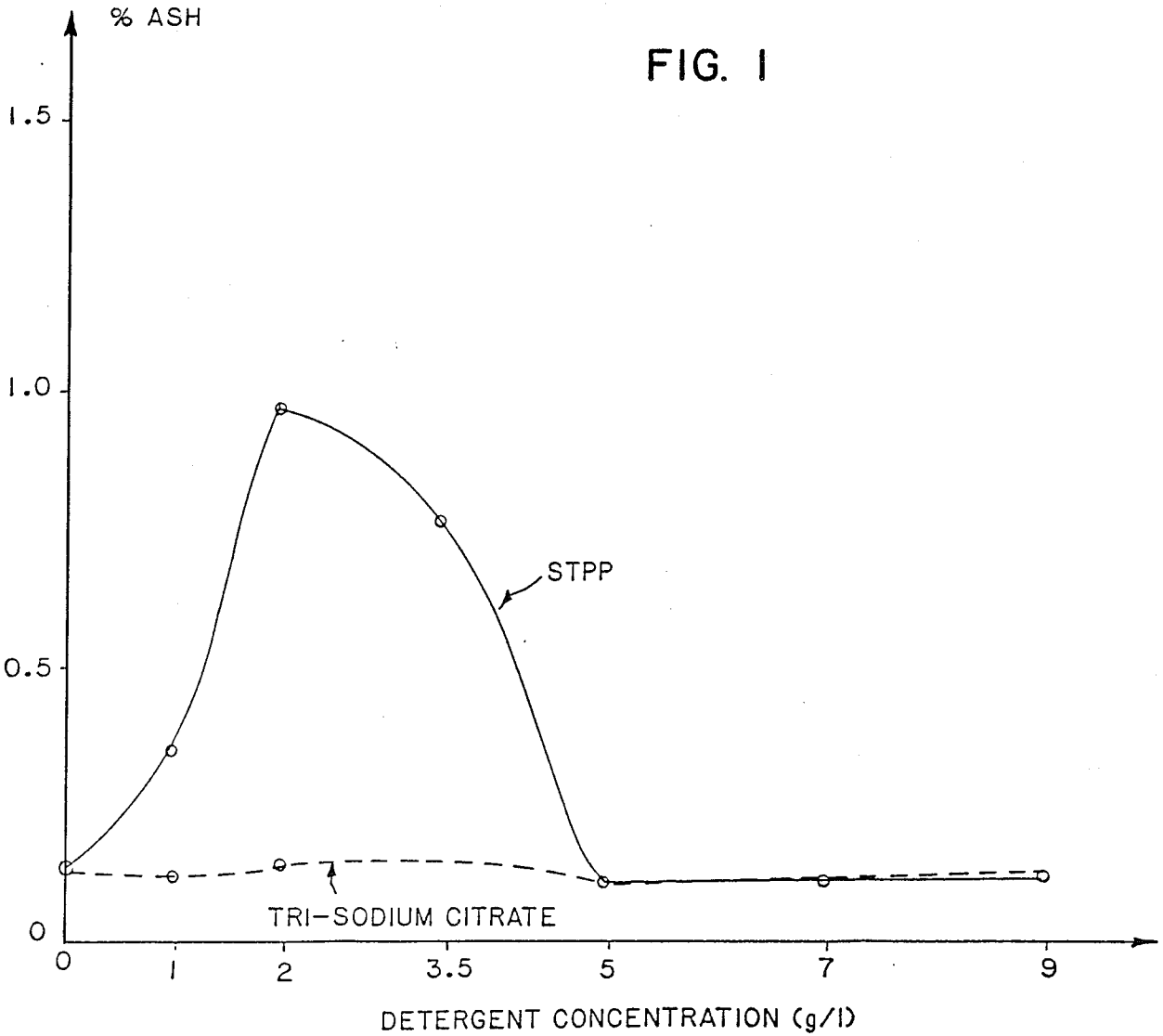

In accordance with the invention, a non-aqueous liquid laundry detergent, preferably one that is readily pourable, is pre-packaged in premeasured dosage forms for single use in discardable packets or sachets.

A multicomponent disposable sachet dispenser is used of the type generally disclosed in U.S. Pat. No. 4,348,293 to Clarke, et al. the disclosure of which as it relates to the bag construction, materials and fabrication, is incorporated herein by reference thereto. Accordingly, only the preferred embodiments and unique features of the multicomponent sachets to be used in this invention need be described. The sachet dispenser includes an outer pouch or bag of a water-permeable or porous water-insoluble film or fabric and an inner pouch or bag of a water-soluble or dispersible, liquid impermeable film. The inner bag is filled with the appropriate unit dosage of the non-aqueous liquid detergent composition and is then sealed. The outer bag is sealed around the inner bag which may be free floating therein, i.e. not attached to the walls of the outer bag, or it may be sealed to one or more edges or walls thereof by any suitable means, such as adhesives, heat sealing, staples, sewing, etc. In use in the aqueous wash bath the water from the bath permeates or flows through the outer bag and contacts the inner bag which then dissolves upon exposure to the water and exposes the detergent composition to the wash water inside the pouch and allows the fabric treating detergent, detergent builder, and so on, to permeate out of the outer bag to the aqueous wash bath. In this way, the invention composition can be gradually introduced into the wash bath during the wash cycle, preferably over the course of one or more minutes, for example, within 1 to 5 minutes, such as about 2 to 3 minutes. Although the non-water-soluble outer bag can be fabricated from a perforated water-insoluble material, e.g. resin impregnated paper, wax paper, viscose, polyolefin film, polyester film, etc. it is preferred to form the outer bag from non-woven fabric using fibers of natural or synthetic origins or mixtures thereof. Nonwoven polyester fabrics of density ranging from about 10 to 40 grams per square meter, preferably 15 to 30 grams per square meter, especially 18 to 24 grams per square meter have proven effective in practice.

Another preferred material for the outer bag is highly porous spun-bonded non-woven polypropylene. The fabric density may be the same as described for the non-woven polyester fabrics.

Other suitable fiber materials include, for example, polyamides, polyacrylics, polyolefins, such as polyethylene, polypropylene, ethylene-propylene copolymers, etc., polyvinyl chloride, polyvinylidene chlorine, rayon, cellulose and the like.

It has been found convenient for most product formulations to use from about 50 to 150 grams of the detergent composition, preferably 60 to 120 grams, such as 70, 80, 90, 100 or 110 grams, per wash, this amount conveniently fitting in a single sachet dispenser, measuring, for example, from about 3 to 4 or more inches per side, such as 3.5 in. or 3.75 in. or 4 in. per side.

Polyvinyl alcohol having a degree of hydrolysis of at least 60%, preferably 80 to 100%, such as 85 to 98%, e.g. 88% is preferably used as the water-soluble film or sheet for forming the water-soluble liquid impermeable inner bag of the sachet. Other water-soluble films or sheets can also be used. For example, mention may be made of polyethylene oxide, methyl cellulose, gelatine, polysaccharides, polyacrylic acid and the like.

In order to make the water-soluble film material impervious to the non-aqueous liquid phase it is important that it be non-porous and such non-porous films are readily commercially available. Furthermore, the film material should have suitable thickness. Generally, depending on the nature of the water-soluble film material thicknesses of at least about 4 mil (.0.004 inch), preferably at least 10 mil will be selected. On the other hand the film should not be so thick as to require excessively long periods for dissolution after placement in the wash bath. Therefore, thickness up to about 100 mil, preferably up to about 50 mil will be selected.

Another important factor for selection of suitable water-soluble film-forming material to obtain the required impermeability to the non-aqueous liquid phase while still having acceptable dissolution properties is the molecular weight of the film. For instance, in the case of polyvinyl alcohol films a molecular weight of about 40,000 provides fast dissolution rates, even in cold water, but could be partially permeable to the non-aqueous liquid phase. Polyvinyl alcohol films with molecular weight of about 80,000 are non-permeable to the non-aqueous liquid phase but require longer periods to dissolve in cold water, but rapidly dissolve in warm water (about 30° C or higher). Therefore, for liquid detergent compositions to be acceptable for us with cold wash water, polyvinyl alcohol films with molecular weights of from about 45,000 to about 75,000 are preferred although lower or higher molecular weights may be acceptable. For use under warm water conditions higher molecular weights, e.g. from about 60,00 to 100,000 offer acceptable dissolution rates and good liquid impermeability.

Appropriate molecular weight ranges can be easily determined for other water-soluble film forming materials and for any particular non-aqueous liquid detergent composition by routine experimentation.

As an alternative to the use of water soluble films for the inner protective bag layer it is possible to use perforated films of water-insoluble materials with the perforations filled or "blocked" with a water-soluble substance, such as any of the water-soluble substances mentioned above. The holes, or perforations, can cover, for example, from about 20 to 80% of the total area of one or both major sides of the inner bag and may conveniently range from about ⅛ square inch to about ½ square inch in area. The perforations can be in any desired geometrical configuration and array, e.g. circular perforations in a square pattern, star-shaped perforations in a circular pattern, etc.

The use of a double wall sachet wherein the outer wall is formed of a sealed water-insoluble water-permeable material has several advantages. The water-insoluble outer bag can protect the water-soluble inner bag from exposure to moisture, e.g. humidity, during storage, but being water-permeable will allow exposure of the water-soluble film and liquid detergent product to the aqueous wash bath so that the detergent and fabric treating ingredients can be dispersed to the fabrics during the wash cycle. Furthermore, because the outer bag of the sachet is and remains sealed during the washing, rinsing, and spin-dry operations of the washing machine, any residue of the water-soluble inner bag will be substantially retained within the sachet rather than being deposited on the fabric being laundered. For instance, portions of the partially hydrolyzed polyvinyl acetate may be water-insoluble and form clumps upon dissolution of the water-soluble portions. These clumps will be substantially retained within the water-insoluble outer bag. Also, it may in some case be advantageous to render the inner bag partially water-insoluble, for example, by a wax coating, to enhance storage stability. This wax coating will also be retained within the permeable but insoluble outer bag of the sachet.

However, it has been found that, in practice, effective and convenient means for protecting the water-soluble inner bag and its liquid content from premature exposure to moisture, whether water vapor in humid environments, or accidental contact with water during storage, shipment or during use and handling by the consumer, is simply to provide a removable protective water-insoluble water-impermeable wrapper as the outermost layer of the sachet.

Any water-insoluble water-impermeable (e.g. nonporous) film forming material can be used for this purpose. For example, mention may be made of polyolefin films, polyester films, polyvinyl chloride films, polyvinylidene chloride and other polymer materials, water resistant papers, wax papers, metal foil, e.g. aluminum foil, and the like. In this context, the water-insoluble water-impermeable protective outermost wrapper is to be distinguished from the "removable water-insoluble protecting agent" as used in the aforementioned U.S. Pat. No. 4,348,293 which is applied as a coating to the water-insoluble water-permeable film and which depends on being dispersed in the wash bath for removal.

Thus, the outermost wrapper may be formed in any convenient structure which permits its easy removal by the consumer. For example, baggie-type (e.g. PVDC) pouches may be used with the open end temporarily closed by a tie string, or by a lock fit, or peelable adhesion. Alternatively, the heat sealable plastic materials may be heat sealed along all open edges (e.g. all four edges when two separate film sheets are used or along three edges when a single film sheet is folded on itself) and provided with a frangible score line, or notched at one edge o allow easy tearing. Biaxially oriented polypropylene film is easily tearable and is highly waterproof. When metal foil is used as the outermost protective wrapper it too may be temporarily sealed by any convenient means, such as by adhesive, or the metal foil may be simply securely folded upon itself according to well known means.

By virtue of the outermost protective waterproof wrapper the detergent product may be stored under high humidity conditions or may be otherwise exposed to water without causing premature dissolution of the inner water-soluble bag or leaking of the liquid detergent composition.

In addition to its protective function against exposure to moisture, the outermost protective wrapper also protects the water-permeable outer bag from contact with ambient dirt and dust which might adversely effect the permeability of the product. Furthermore, especially for the non-woven fabric types of outer bag material, dirt or dust particles may become entrapped in the fibrous material and render the article unacceptable to the end user.

While the outermost protective wrapper has been described as a separate, independent cover, it is also possible to laminate the outermost wrapper to the water-insoluble water-permeable outer bag using a peelable adhesive or by heat sealing along one or more edges.

In any case, it is a simple task for the consumer to remove the outermost protective wrapper before the detergent product is placed in the laundry machine.

As described in Clarke, et al. U.S. Pat. No. 4,348,293 it is also possible to provide suitable markings, e.g. printed advertisements, designs, instructions for use, etc., on either or both of the outermost waterproof protective wrapper or the outer water-permeable bag.

It is also within the scope of the invention to provide a coating on the fibers of the outer water-insoluble, water-permeable non-woven fabric bag of a fabric softening composition, such as a cationic quaternary ammonium salt, perhaps with a water-insoluble wax, such that the softening agent will not be activated (released) until the sachet is transferred, together with the wash textile fabrics, to a clothes drier. Such "through the wash" fabric softening materials are, per se, known in the art.

Similarly, the non-woven fabric may be impregnated with perfume or fragrance to be transferred to the washed articles.

Also, the detergent products, in any of the foregoing embodiments, may be formed in a conjoined manner, for example, in a strip, with severable joints, to facilitate dosing of different numbers of bags as appropriate for different washing conditions and laundry loads.

The liquid detergent composition of the detergent product will now be described.

The liquid phase of the non-aqueous liquid detergent composition of this invention is comprised of liquid nonionic synthetic organic detergent and alkylene glycol monoalkyl ether, as a viscosity control and antigelling agent. A portion of the liquid phase may be composed, however, of other organic solvents which may enter the composition as solvent vehicles or as carriers for one or more of the solid particulate ingredients, such as in enzyme slurries, perfumes, and the like.

The nonionic synthetic organic detergents employed in the practice of the invention may be any of a wide variety of such compounds, which are well known and, for example, are described at length in the text *Surface Active Agents,* Vol. II, by Schwartz, Perry and Berch, published in 1958 by Interscience Publishers, and in McCutchen's *Detergents and Emulsifiers,* 1969 Annual, the relevant disclosures of which are hereby incorporated by reference. Usually, the nonionic detergents are polylower alkoxylated lipophiles wherein the desired hydrophile-lipophile balance is obtained from addition of a hydrophilic polylower alkoxy group to a lipophilic moiety. A preferred class of the nonionic detergent employed is the polylower alkoxylated higher alkanol wherein the alkanol is of 10 to 22 carbon atoms and wherein the number of mols of lower alkylene oxide (of 2 or 3 carbon atoms) is from 3 to 20. Of such materials it is preferred to employ those wherein the higher alkanol is a higher fatty alcohol of 10 to 11 or 12 to 15 carbon atoms and which contain from 5 to 18, preferably 6 to 14 lower alkoxy groups per mol. The lower alkoxy is often just ethoxy but in some instances it may be preferably mixed with propoxy. Exemplary of such ethoxylated alcohols are those wherein the alkanol is of 12 to 15 carbon atoms and which contain about 7 ethylene oxide groups per mol, e.g., Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide, and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols with the higher fatty alcohol being of 14 to 15 carbon atoms and the number of ethylene oxide groups per mol being about 11. Such products are also made by Shell Chemical Company.

Another group of liquid nonionics, also available from Shell Chemical Company, Inc. under the Dobanol trademark include, for example, Dobanol 91-5, an ethoxylated $C_9$-$C_{11}$ fatty alcohol with an average of 5 moles ethylene oxide; and Dobanol 25-7 an ethoxylated $C_{12}$-$C_{15}$ fatty alcohol with an average of 7 moles ethylene oxide; etc.

Other highly useful nonionics are represented by the commercially well-known class of nonionics which are the reaction product of a higher linear alcohol and a mixture of ethylene and propylene oxides, containing a mixed chain of ethylene oxide and propylene oxide, terminated by a hydroxyl group. Examples include the nonionics sold under the Plurafac trademark of BASF, such as a $C_{13}$-$C_{15}$ fatty alcohol condensed with 7 moles propylene oxide and 4 moles ethylene oxide, a $C_{13}$-$C_{15}$ fatty alcohol condensed with 5 moles propylene oxide and 10 moles ethylene oxide, a $C_{13}$-$C_{15}$ fatty alcohol condensed with 6 moles ethylene oxide and 3 moles propylene oxide, etc.

Generally, the mixed ethylene oxide-propylene oxide fatty alcohol condensation products represented by the general formula $$RO(C_3H_6O)_p(C_2H_4O)_qH,$$

wherein R is a straight or branched, primary or secondary aliphatic hydrocarbon, preferably alkyl or alkenyl, especially preferably alkyl, of from 6 to 20, preferably 10 to 18, especially preferably 12 to 18 carbon atoms, p is a number of from 2 to 8, preferably 3 to 6, and q is a number of from 2 to 12, preferably 4 to 10, can be advantageously used where low foaming characteristics are desired. In addition, these surfactants have the advantage of low gelling temperatures. Mixtures of two or more of the mixed ethylene oxide-propylene oxide fatty alcohol condensation product can be used as can mixtures of the mixed ethylene oxide-propylene oxide condensation products with any of the above alkoxylated nonionics, or mixtures of the ethoxylated nonionics can also be used.

In the preferred polylower alkoxylated higher alkanols, to obtain the best balance of hydrophilic and lipophilic moieties the number of lower alkoxies will usually be from 40% to 100% of the number of carbon atoms in the higher alcohol, such as 40 to 60% thereof and the nonionic detergent will often contain at least 50% of such preferred polylower alkoxy higher alkanol.

Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the alkoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the alkylene oxide chains are highly preferred and are considered to result in the best combination of detergency, biodegradability and non-gelling characteristics, medial or secondary joinder to the alkylene oxide in the chain may occur. It is usually in only a minor proportion of such alkyls, generally less than 20% but, as is the case of the mentioned Terigtols, may be greater.

When greater proportions of non-terminally alkoxylated alkanols, propylene oxide-containing polylower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of viscosity and gel controlling compounds can also improve the properties of the detergents based on such nonionics. In some cases, as when a higher molecular weight polylower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

In view of their low gelling temperatures and low pour points, another preferred class of nonionic surfactants includes the $C_{12}$-$C_{13}$ secondary fatty alcohols with relatively narrow range of contents of ethylene oxide within the range of from about 7 to 9 moles, especially about 8 moles ethylene oxide per molecule and the C9 to $C_{11}$, especially $C_{10}$ fatty alcohols ethoxylated with about 6 moles ethylene oxide.

The compositions of this invention include an organic alkylene glycol alkyl ether solvent which functions as a viscosity control and gel-inhibiting agent for the liquid nonionic surface active agent. Alkylene glycol alkyl ethers, such as the compounds sold under the trademarks, Carbopol and Carbitol which have relatively short hydrocarbon chain lengths ($C_2$-$C_8$) and a low content of alkylene oxide (about 2 to 6 ethylene oxide and/or propylene oxide units per molecule) are especially useful viscosity control and antigelling solvents in the compositions of this invention. Suitable glycol ethers can be represented by the following general formula $$R^1O(CH_2\overset{\overset{R^2}{|}}{C}HO)_nH$$

where $R^1$ is a $C_1$-$C_8$, preferably $C_1$-$C_5$, alkyl group, $R^2$ is hydrogen or methyl and n is a number of from about 1 to 6, preferably 1 to 4, on average.

The glycol ethers may also be considered as condensation products of $C_1$–$C_8$ alcohols with ethylene oxide or propylene oxide at molar ratios of alcohol to alkoxide of from 1:1 to 6:1.

Specific examples of suitable solvents include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monooctyl ether ($C_8H_{17}$—O—$(CH_2CH_2O)_4H$), tripropylene glycol methyl ether ($CH_3$—O—$(CH_2CH(CH_3)O)_3H$), etc. Diethylene glycol monobutyl ether and tripropylene glycol monomethyl ether are preferred and tripropylene glycol methyl ether is especially preferred.

The amount of the nonionic surfactant is generally within the range of from about 20 to about 70%, such as about 30 to 60%, for example, 35% or 40% by weight of the composition. The amount of alkylene glycol ether is usually up to 20%, preferably up to 15%, for example, 0.5 to 15%, preferably 5.0 to 12.5%, such as 8%, 10% or 12%. The weight ratio of nonionic surfactant to alkylene glycol ether viscosity control and antigelling agent is in the range of from about 100:1 to 1:1, preferably from about 50:1 to about 2:1, such as 10:1, 8:1, 6:1, 4:1 or 3:1.

The invention detergent compositions also include, as an essential ingredient, water-soluble and/or water-dispersible detergent builder salts of hydroxy polycarboxylic acid having from 4 to 8 carbon atoms. These builder salts may have two or three carboxylic acid groups and from 1 to 4 hydoxy groups per molecule. Preferably there are from 4 to 6 carbon atoms inclusive of the carboxyl carbon atoms per molecule. Examples of suitable acids include malic acid, $HO_2CCH_2CH(OH)CO_2H$; tartaric acid, $HO_2CCH(OH)CH(OH)CO_2H$; citric acid, $HO_2CCH_2C(OH)(CO_2H)CH_2CO_2H$; isocitric acid, $HO_2CCH_2CH(CO_2H)CH(OH)CO_2H$; tricarballylic acid (1,2-dihydroxy-1,2,3-propylenetricarboxylic acid), $HO_2CCH_2C(OH)(CO_2H)CH(OH)CO_2H$; trihydroxyglutaric acid, $HO_2CCH(OH)CH(OH)CH(OH)CO_2H$; mucic acid, $HO_2CCH(OH)CH(OH)CH(OH)CH(OH)CH_2H$. Citric acid and tartaric acid are preferred.

As the cation of the salts of these acids the alkali metals, such as sodium and potassium, are preferred, particularly sodium. Furthermore, the salts may take the form of the mono-, di- or tri-salt, suchaas monosodium, disodium or trisodium citrate, preferably the latter. However, where monosodium or disodium citrate is used it is preferred to add a supplemental alkaline builder salt, such as sodium silicate, e.g. disodium silicate, to adjust the pH to about the same level as obtained when using the trisodium citrate. Similarly, when using monosodium tartrate additional alkaline compounds can be added to increase the pH level to the desired alkaline range. Furthermore, the salts can be used in their anhydrou or hydrated form, e.g. sodium citrate, dihydrate.

The alkali metal mono- or poly-hydroxy- di- or tricarboxylic acid salts have the advantage of their high calcium and magnesium binding capacity which enables them to inhibit formation of insoluble calcium and magnesium salts, namely the builders of this invention are superior antiencrustation agents.

In order to effectively function as antiencrustation agents, the hydroxy polycarboxylic acid builder salts are present in the composition in amounts of at least about 10%, preferably at least about 20%, and up to about 60%, preferably up to about 50%, for example, in the range of from about 15 or 20% to about 50 to 66%, especially preferably in the range of from about 25 to 45%, based on the total composition and further preferably constitute at least 50% by weight, preferably at least 75% by weight, of the total suspended solid particles present in the composition.

In addition to the essential hydroxy polycarboxylic acid salts, amounts of other conventional, preferably nonpolyphosphate type, inorganic and/or organic builder salts can also be included in the composition. Typical suitable builders include, for example, those disclosed in the aforementioned U.S. Pat. Nos. 4,316,812; 4,264,466; 3,630,929 and many others. Water-soluble inorganic alkaline builder salts which can be used in admixture with the hydroxy polycarboxylic acid builders include alkali metal carbonates, borates, bicarbonates and silicates. (Ammonium or substituted ammonium salts can also be used.) Specific examples of such salts are sodium carbonate, sodium tetraborate, sodium bicarbonate, sodium sesquicarbonate, and potassium bicarbonate.

Although it is preferred that the detergent composition be free of phosphate or polyphosphate builders, in some cases small amounts of the conventional polyphosphate builder salts can be added where the local laws permit such use. Specific example of such builder salts include sodium or potassium tripolyphosphate, sodium potassium pyrophosphate, sodium hexametaphosphate, sodium mono- and diorthophosphate. Sodium tripolyphosphate (TPP), usually in amounts up to about 30%, preferably up to about 20%, such as from 5 to 15%, is especially preferred where phosphate containing ingredients are not prohibited due to environmental concerns. However, more preferably, the amount of phosphate or polyphosphate builder should not exceed 10%, for example, 0 to 6%, preferably 0 to 3%. No phosphate compositions are especially preferred.

The alkali metal silicates are useful builder salts for increasing alkalinity and also function to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

Another class of inorganic builders which can be used are the water-insoluble aluminosilicates, both of the crystalline and amorphous type. Various crystalline zeolites (i.e. aluminosilicates) are described in British Patent 1,504,168, U.S. Pat. No. 4,409,136 and Canadian Patents 1,072,835 and 1,087,477, all of which are hereby incorporated by reference for such descriptions. An example of amorphous zeolites useful herein can be found in Belgium Patent 835,351 and this patent too is incorporated herein by reference. The zeolites generally have the formula $$(M_2O)x.(Al_2O_3)y.(SiO_2)z.WH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetretraacetate (EDTA), sodium and potassium nitrilotriacetates (NTA) and triethanolammonium N-(2hydroxyethyl)nitrilodiacetates. Mixed salts of these polycarboxylates are also suitable.

Suitable additional builders of the organic type include carboxymethylsuccinates, tartronates and glycollates and the polyacetal carboxylates. The polyacetal carboxylates and their use in detergent compositions are described in 4,144,226; 4,315,092 and 4,146,495. Other patents on similar builders include 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0,015,024; 0,021,491 and 0,063,399.

The total proportion of the suspended detergent builder, including the hydroxy polycarboxylic acid salt and any of the other optional inorganic and/or organic builder salts, based on the total composition, is usually in the range of from about 10 to 55 weight percent, such as about 20 to 50 weight percent, for example about 25 to 40% by weight of the composition. Above about 55% it becomes extremely difficult, even at high solvent levels, to form easily flowable and pourable compositions.

Since the compositions of this invention are generally highly concentrated, and, therefore, may be used at relatively low dosages, it is often desirable to supplement the hydroxy polycarboxylic acid builder salt with an auxiliary builder such as a polymeric carboxylic acid having high calcium/magnesium binding capacity to further inhibit incrustation which could otherwise be caused by formation of insoluble calcium or magnesium salts. Such auxiliary builders are also well known in the art. For example, mention can be made of the polyacrylic builders, such as Sokolan CP5 which is a copolymer of about equal moles of methacrylic acid and maleic anhydride, completely neutralized to form the sodium salt thereof. The amount of the auxiliary builder is generally up to about 6 weight percent, preferably ¼ to 4%, such as 1%, 2% or 3%, based on the total weight of the composition.

In addition to the detergent builders, various other detergent additives or adjuvants may be present in the detergent product to give it additional desired properties, either of functional or aesthetic nature. Thus, there may be included in the formulation, minor amounts of soil suspending or antiredeposition agents, e.g. polyvinyl alcohol, fatty amides, sodium carboxymethyl cellulose, hydroxy-propyl methyl cellulose, etc., usually in amounts of up to 10 weight percent, for example 0.1 to 10%, preferably 1 to 5%; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene brightener up to about 2 weight percent, preferably up to 1 weight percent, such as 0.1 to 0.8 weight percent, can be used.

Bluing agents such as ultramarine blue; enzymes, preferably proteolytic enzymes, such as subtilisin, bromelin, papain, trypain and pepsin, as well as amylase type enzymes, lipase type enzymes, and especially preferably mixtures of two or three different classes thereof; bactericides, e.g. tetrachlorosalicylanilide, hexachlorophene; fungicides; dyes; pigments (water-dispensable); preservatives; ultraviolet absorbers; antiyellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and antifoam agents or suds-suppressor, e.g. silicon compounds can also be used.

The bleaching agents are classified broadly for convenience, as chlorine bleaches and oxygen bleaches. Chlorine bleaches are typified by sodium hypochlorite (NaOCl), potassium dischloroisosyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No.4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and akenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with $Cu2+$ ions, such that the stability constant (pK) of the complexation is equal to or greater than 6, at 25° C, in water, of an ionic strength of 0.1 mole/liter, pK being conventionally defined by the formula: $pK = -\log K$ where K represents the equilibrium constant. Thus, for example, the pK values for complexation of copper ion with NTA and EDTA at the stated conditions are 12.7 and 18.8, respectively. Suitable sequestering agents include, for example, in addition to those mentioned above, the compounds sold under the Dequest trademark, such as, for example, diethylene triamine pentaacetic acid (DETPA); diethylene triamine pentamethylene phosphoric acid (DTPMP); and ethylene diamine tetramethylene phosphoric acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred non-aqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

Although not required to achieve acceptable product stability, it is also within the scope of this invention to include other suspension stabilizers, rheological additives, and antigelling agents.

Thus, as disclosed in the parent application Ser. No. 063,199 filed June 12, 1987, the disclosure of which is incorporated herein in its entirety by reference thereto, physical stability of the suspension of detergent builder compound or compounds, and any other suspended additive, such as bleach agent, etc. may be improved by an elastic network forming organophilic modified clay. Briefly, these modified clays are based on swelling clays, such as the smectite clays, especially bentonites, montmorillonites and hectorites, which have been modified to swell in the non-aqueous medium of the present liquid detergent compositions. In particular, an organophilic nature is imparted to these clays by exchange of the metal cation, e.g. Na, K, Li, Ca, etc. of the clay, with an organic cation, particularly a quaternary ammonium compound. Suitable organophilic clays are commercially available, for example, the products sold under the Bentone trademark of NL Industries, New York. The organophilic clays can be added in amounts up to about 1.0% by weight, preferably less than 0.7% by weight, based on the total composition. Usually amounts of at least 0.1%, preferably at least 0.2%, will provide stable suspensions.

Other suspension stabilizers can be used in place of, or in addition to, the organophilic clays. For example, the aluminum salts of higher fatty acids, especially aluminum stearate, as disclosed in U.S. Pat. No. 4,661,280, the disclosure of which is incorporated herein by reference, can be added to the composition, for example, in amount of 0 to 3% by weight, preferably 0 to 1% by weight, such as 0.05 to 0.8% by weight.

Another potentially useful stabilizer is an acidic organic phosphorus compound having an acidic -POH group, as disclosed in the commonly assigned copending application Ser. No. 781,189, filed Sept. 25, 1985, to Broze, et al., the disclosure of which is incorporated herein by reference thereto. The acidic organic phosphorus compound, may be, for instance, a partial ester of phosphoric acid and an alcohol, such as an alkanol having a lipophilic character, having, for instance, more than 5 carbon atoms, e.g. 8 to 20 carbon atoms. A specific example is a partial ester of phosphoric acid and a $C_{16}$ to $C_{18}$ alkanol. Empiphos 5632 from Marchon is made up of about 35% monoester and 65% diester. When used, amounts of the phosphoric acid compound up to about 3%, preferably up to 1%, are sufficient.

As disclosed in copending application Ser. No. 926,851, filed Nov. 3, 1986, to Broze, et al., the disclosure of which is incorporated herein by reference, a nonionic surfactant which has been modified to convert a free hydroxyl group to a moiety having a free carboxyl group, such as a partial ester of a nonionic surfactant and a polycarboxylic acid, can be incorporated into the composition to further improve rheological properties. For instance, amounts of the acid-terminated nonionic surfactant of up to 1 per part of the nonionic surfactant are sufficient.

Suitable ranges of these optional detergent additives are: enzymes —0 to 2%, especially 0.1 to 1.3%; corrosion inhibitors —about 0 to 40%, and preferably 0 to 30%; antifoam agents and suds-suppressor —0 to 15%, preferably 0 to 5%, for example 0.1 to 3%; thickening agent and dispersants —0 to 15%, for example 0.1 to 10%, preferably 0.1 to 5%; soil suspending or antiredeposition agents and antiyellowing agents —0 to 10%, preferably 0.5 to 5%; colorants, perfumes, brighteners and bluing agents total weight 0% to about 2% and preferably 0% to about 1%; pH modifiers and pH buffers —0 to 5%, preferably 0 to 2%; bleaching agent —0% to about 40% and preferably 0% to about 25%, for example 2 to 20%; bleach stabilizers and bleach activators 0 to about 15%, preferably 0 to 10%, for example, 0.1 to 8%; enzyme-inhibitors 0 to 15%, for example, 0.01 to 15%, preferably 0.1 to 10%; sequestering agent of high complexing power, in the range of up to about 5%, preferably ¼ to 3%, such as about ½ to 2%. In the selections of the adjuvants, they will be chosen to be compatible with the main constituents of the detergent composition.

Preferred detergent compositions of this invention are formulated using the below named ingredients in the preferred (broad), more preferred (intermediate) and most preferred (narrow) proportions:

| | Weight % | | |
|---|---|---|---|
| | Broad | Intermediate | Narrow |
| Nonionic surfactant detergent | 20–50 | 28–50 | 30–46 |
| Alkali metal hydroxy polycarboxylic acid builder salt | 20–42 | 22–40 | 25–37 |
| Antiencrustation agent, e.g. copolymer of methacrylic acid and maleic anhydride, alkali metal salt | 0–5 | 1–3 | 1.5–2.5 |
| Other builder salt(s) | 0–30 | 0–20 | 0–10 |
| Alkylene glycol alkyl ether, viscosity reducing solvent/antigel agent | 6–20 | 8–15 | 8–12.5 |
| Alkanol phosphoric acid ester | 0–1 | 0–0.5 | 0–0.2 |
| Acid terminated nonionic surfactant | 0–10 | 0–8 | 0–4 |
| Alkali metal perborate bleaching agent | 0–20 | 8–15 | 9–13.5 |
| Bleach activator | 0–8 | 3–6 | 3.5–5.5 |
| Alkali metal silicate corrosion inhibitors | 0–20 | 0–15 | 0–10 |
| Sequestering agent | 0–4 | 0.2–1.0 | 0.4–0.6 |
| Antiredeposition agent | 0–5 | 0.6–1.5 | 0.8–1.25 |
| Optical Brightener | 0–0.8 | 0.2–0.6 | 0.25–0.4 |
| Enzymes | 0–2 | 0.1–1.3 | 0.4–0.7 |
| Perfume | 0–1 | 0.2–1.0 | 0.4–0.6 |
| Dye and/or Pigment | 0–1 | 0.2–0.6 | 0.3–0.5 |
| Antifoam agents and suds suppressors | 0–15 | 0–5 | 0–3 |

In a preferred form of the invention, the mixture of liquid nonionic surfactant and solid ingredients is subjected to grinding, for example, by a sand mill or ball mill. Especially useful are the attrition types of mill, such as those sold by Wiener-Amsterdam or Netzsch-Germany, for example, in which the particle sizes of the solid ingredients are reduced to less than about 15 microns, e.g. to an average particle size of 2 to 10 microns or even lower (e.g. 1 micron). Preferably, less than about 10%, especially less than about 5% of all the suspended particles have particle sizes greater than 15 microns, preferably 10 microns. Since the hygroscopicity of the ground particles, especially when present, clay generally increases as particles size decreases it is often preferred that the average particle size be at least 3 microns, especially about 4 microns. Compositions whose dispersed particles are of such small size have improved stability against separation or settling on storage. Other types of grinding mills, such as toothmill, peg mill and the like, may also be used.

In the grinding operation, it is preferred that the proportion of solid ingredients be high enough (e.g. at least about 40%, such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 15 microns in the continuous ball mill.

Alternatively, the powdery solid particles may be finely ground to the desired size before blending with the liquid matrix, for instance, in a jet-mill.

The compositions of this invention may be, and preferably are, formulated as easily pourable liquid suspensions, having viscosities ranging from about 50 to 8,000 m Pa·sec (50 to 8,000 centipoise), usually from about 80 to 6,000 m Pa·sec, such as 160, 200 or 240 m Pa·sec on the low end or 2,000, 2,500, 3,000, 4,000 or 5,000 m Pa·sec on the high end, such that the product is readily flowable even at temperatures as low as 5° C or below. In order to achieve the preferred viscosity range and easy pourability, the solids loading of the suspension, including builders, bleach, and the like, should generally, depending on such factors as particle size, liquid phase ingredients, types of suspended particles, and the like, be maintained at a total amount of less than about 55%, especially less than 50%, based on the weight of the composition. Thickening agents and stabilizers, such as the above-mentioned organophilic clays, aluminum stearate, and the like, should be avoided or used at very low levels, for example, 0.01 to 0.2% of the organophilic clay, and 0.01 to 0.1% of aluminum stearate or other mono- or polyvalent metal salt of a $C_{12}$ to $C_{22}$ aliphatic fatty acid.

The compositions of this invention may be packaged in ordinary vessels, such as glass or plastic, rigid or flexible bottles, jars of other containers. Since they are readily flowable at temperatures as low as 5° C they are easily pourable and can be dispensed directly from the container into the aqueous wash bath, such as in an automatic washing machine, in usual amounts, such as ¼ to ½ cups, for example, ½ cup, per laundry load (of approximately 3 to 15 pounds, for example), for each load of laundry, usually in 8 to 18 gallons of water. The preferred compositions will also remain stable (no more than 1 or 2 mm liquid phase separation) when left to stand for periods of 3 months or longer.

It in also possible, especially where thickeners are added to the composition, to transfer (some shaking or shear force may be necessary or helpful) the thickened (e.g. thixotropic or gel-like) composition into a perforated dispenser (referred to as a "doserette"), such as a plastic (water-insoluble) ball, having an inner volume preferably just sufficient to hold up to 1 ½ cups, or other appropriate amount corresponding to the maximum recommended dosage for a large load of laundry. For this purpose the ball is provided with a closable wide fill opening through which the composition can be poured and then closed, for example, a screw cap, friction cap or the like. The perforations will be sufficiently small, for example, 1/64-inch to ⅜-inch, preferably 1/64 to 1/16 inch, in diameter, to prevent the thickened composition from freely flowing out of the perforations in the doserette. However, the perforations are sufficiently large to allow the water of the aqueous wash bath to freely flow into the doserette and to sufficiently dilute the thickened suspension so as to allow the composition to be washed out of the doserette into the aqueous wash bath over the first several minutes of the wash cycle, for example in about 1 to 3 minutes. In this way, the consumer can readily fill the doserette to the appropriate level for the amount and type of laundry being washed and place the filled doserette (after sealing the fill opening) directly into the washing machine with the load of laundry. Preferably, the doserette is formed of sufficiently strong plastic, such as polystyrene, polyethylene, polypropylene, polyvinyl chloride, etc. to be able to withstand repeated usage.

In the preferred embodiment wherein the non-aqueous liquid detergent composition is provided in the form of a unitary package as described above, it may not be as critical to formulate the composition with ingredients which inhibit phase separation since there is less problem of using the proper proportion of ingredients, since the entire package will normally be added to the wash bath. Similarly, when single dose packages are provided to the consumer, pourability is not, per se, such an essential criteria, and the compositions may be more viscous, e.g. up to about 50,000 cps or more, or gel-like or thixotropic.

However, here too, readily pourable compositions, especially in the viscosity range of from about 1000 to 8000 cps, preferably 2000 to 6000 cps. Within the preferred viscosity range the package filling operation is often facilitated. In addition, with these still flowable and pourable compositions, the solution rate of the composition into the wash bath may often be higher, as compared to a similar but more viscous or thickened product which may have a greater tendency to settle to the bottom of the wash bath or remain as a coherent mass. In other words, the less viscous pourable compositions preferred herein and which have high dissolution rates in the wash bath can begin to exert their cleaning performance throughout the wash bath more rapidly and will not provide unnecessarily and often undesireably high local concentrations of detergent or other functionally active ingredients. In this regard, the detergent products of this invention are considered to be advantageous over previously proposed unitary packages filled with highly viscous, gel-like or paste formulations.

It is understood that the foregoing detailed description is given merely by way of illustration and that variations may be made therein without departing from the spirit of the invention.

It should also be understood that as used in the specification and in the appended claims the term "non-aqueous" means absence of water, however, small amounts of water, for example up to about 5%, preferably up to about 2%, may be tolerated in the compositions, and therefore, "non-aqueous" compositions can include such small amounts of water, whether added directly or as a carrier or solvent for one of the other ingredients in the composition, or crystallization water (e.g. sodium citrate dihydrate).

The invention will now be described by way of the following non-limiting example in which all proportions and percentages are by weight, unless otherwise indicated. Also, atmospheric pressure is used unless otherwise indicated.

EXAMPLE 1

A non-aqueous built liquid detergent composition according to the invention is prepared by mixing and finely grinding to about 4 microns the following ingredients in the following approximate amounts:

| | Weight % |
|---|---|
| Nonionic Surfactant[1] | 13.5 |
| Nonionic surfactant[2] | 10.0 |
| Nonionic surfactant[3] | 10.0 |
| Acid terminated nonionic surfactant[4] | 5.0 |
| Trisodium citrate | 29.6 |
| Copolymer of methacrylic acid and maleic anhydride, sodium salt | 4.0 |
| Diethylene glycol monobutylether | 10.0 |
| Alkanol phosphoric acid ester | 0.3 |
| Sodium perborate monohydrate | 9.0 |
| Tetraacetylethylene diamine | 4.5 |
| Diethylenetriamine pentamethylene phosphoric acid sodium salt | 1.0 |
| Carboxymethyl cellulose, Na salt/methyl cellulose (2:1 mixture) | 1.0 |
| Optical brightener | 0.5 |
| Esperase SL8 (Protease enzyme) | 1.0 |
| Perfume | 0.5925 |
| Dye | 0.0075 |
| | 100.000 |

[1]An equal mixture of $C_{13}$–$C_{15}$ fatty alcohol condensed with 7 moles of propylene oxide and 4 moles ethylene oxide and $C_{13}$–$C_{15}$ fatty alcohol condensed with 5 moles propylene oxide and 10 moles ethylene oxide.
[2]Secondary $C_{13}$ fatty alcohol ethoxylated with 7 moles ethylene oxide (narrow distribution).
[3]Secondary $C_{13}$ fatty alcohol ethoxylated with 9 moles ethylene oxide (narrow distribution).
[4]Half ester of $C_9$–$C_{11}$ fatty alcohol ethoxylated with 5 moles ethylene oxide and succinic acid anhydride.

EXAMPLE 2

The following non-aqueous liquid laundry detergent composition is prepared:

| | Weight % |
|---|---|
| $C_{13}$–$C_{15}$ fatty alcohol condensed with 7 moles ethylene oxide and 4 moles propylene oxide | 37.9 |
| Tripropylene glycol methyl ether | 10.3 |
| Sodium citrate-dihydrate | 30.5 |
| Sodium perborate, monohydrate | 11.3 |
| Tetraacetyl ethylene diamine | 4.6 |
| Sodium carboxymethyl cellulose | 1.0 |
| Ethylene diamine tetraacetic acid, sodium salt | 0.51 |
| Enzymes | |
| Alcalase 2.5 SL | 0.26 |
| Savinase 8.0 SL | 0.20 |
| Termamyl 300 SL | 0.10 |
| $TiO_2$ (Rutile) | 0.41 |
| Optical Brightener (Tinopal ATS-X) | 0.31 |
| Copolymer of methacrylic acid and maleic anhydride, sodium salt | 2.1 |
| Perfume | 0.51 |
| | 100.00 |

The composition has a viscosity at 25° C of about 5000 cps.

EXAMPLE 3

This example relates to a double wall sachet unitary package according to this invention. Two polyvinyl alcohol films measuring approximately 3.35 inches wide by 3.75 inches long are heat sealed to each other along both longitudinal edges and along a line spaced about 0.2 inches from the bottom edge. The polyvinyl alcohol films used were obtained from Nedi Co. of France, under the tradename NEDOL 210EF (about 85% hydrolyzed polyvinyl alcohol). The PVA pouch is then filled with about 100 grams of the composition described in Example 1 through the opening in the top portion of the pouch. Thereafter the top portion is also heat sealed along a line spaced about 0.2 inches from the top edge. The heat sealing is carried out at a sealing pressure of about 2.0 $Kg/cm^2$ for about 1 second using sealing bars heated to a temperature in the range of about 35° C to 70° C, depending on the relative humidity. For instance, at a relative humidity of 40%, a sealing temperature of from about 55–60° C is satisfactory, while at 70% R. H. a temperature of from 43–49° C is recommended; and at 80% R. H. a temperature of from 38° C to 43° C is recommended.

The outer pouch is formed from a non-woven polyester containing about 40% of binder fiber, having a fabric density of 24 grams per square meter and available from Kendall Co. of Boston, Mass. Two sheets of the non-woven fabric each measuring about 3.75 inches wide by about 4 inches long are placed on either side of the polyvinyl alcohol inner bag such that the side edges of the polyester fabric are equally spaced from the side edges of the inner bag while the bottom and top edges of the inner and outer bags are aligned. The polyester fabric sheets are then heat sealed along the four outer edges thereof to form the outer bag. Furthermore, the outer bag is heat sealed to the inner bag along lines approximately 0.1 inch from the top and bottom edges of the pouch.

When the sachet is placed in a conventional laundry automatic washing machine all of the liquid detergent will be dispensed during the first few minutes of the wash cycle. Clumps of undissolved residual polyvinyl alcohol remaining from the inner bag substantially remain within the sachet at the conclusion of the wash cycle - including the rinse and spin dry cycles.

EXAMPLE 4

Example 3 is repeated except that the composition of Example 2 is filled in the PVA pouch. Similar results are obtained.

EXAMPLE 5

Example 3 is repeated except that in place of the nonwoven polyester fabric, the outer pouch is formed from spunbonded polypropylene having a fabric density of about 20 gm/sq. meter. Results similar to Example 3 are obtained.

EXAMPLE 6

In order to demonstrate the effect on encrustation of the substitution of sodium tripolyphosphate by an equivalent detergent builder amount of trisodium citrate, the detergent composition formulation of Example 1 containing 29.6% by weight of trisodium citrate was compared for a single wash cycle in an automatic laundry washing machine with the same composition in which the trisodium citrate is replaced with 29.6% by weight of sodium tripolyphosphate. Separate wash cycles were carried out with the trisodium citrate and sodium tripolyphosphate detergent compositions at laundry wash water concentrations of each of the detergent compositions of 1, 2, 3.5, 5, 7 and 9 gm/liter.

After each detergent composition was used in a washing machine the amount of encrustation that resulted, i.e. the percent ash deposited, was measured. The percent ash deposited measurement is determined by calcination of washed swatches.

The results observed are reported in the graph illustrated in the FIG. 1 drawing and show that at detergent composition concentrations of 1 to 5 g/1 of wash water the trisodium citrate is substantially better than sodium tripolyphosphate in preventing encrustation or ash deposit. At detergent composition concentrations of about 5 to 9 g/1 of wash water the behavior of trisodium citrate and sodium tripolyphosphate detergent builder salts are about the same in their antiencrustation properties.

EXAMPLE 7

The effect of encrustation buildup in repeated laundry washing machine wash cycles was tested with the same compositions used in Example 6.

The repeated wash cycles were carried out at 5 g/1 wash water concentrations of each of the detergent compositions for twelve washing cycles. The encrustation buildup, i.e. percent ash buildup, was measured in each washing machine after 3, 6, 9 and 12 washings.

Figure 2:
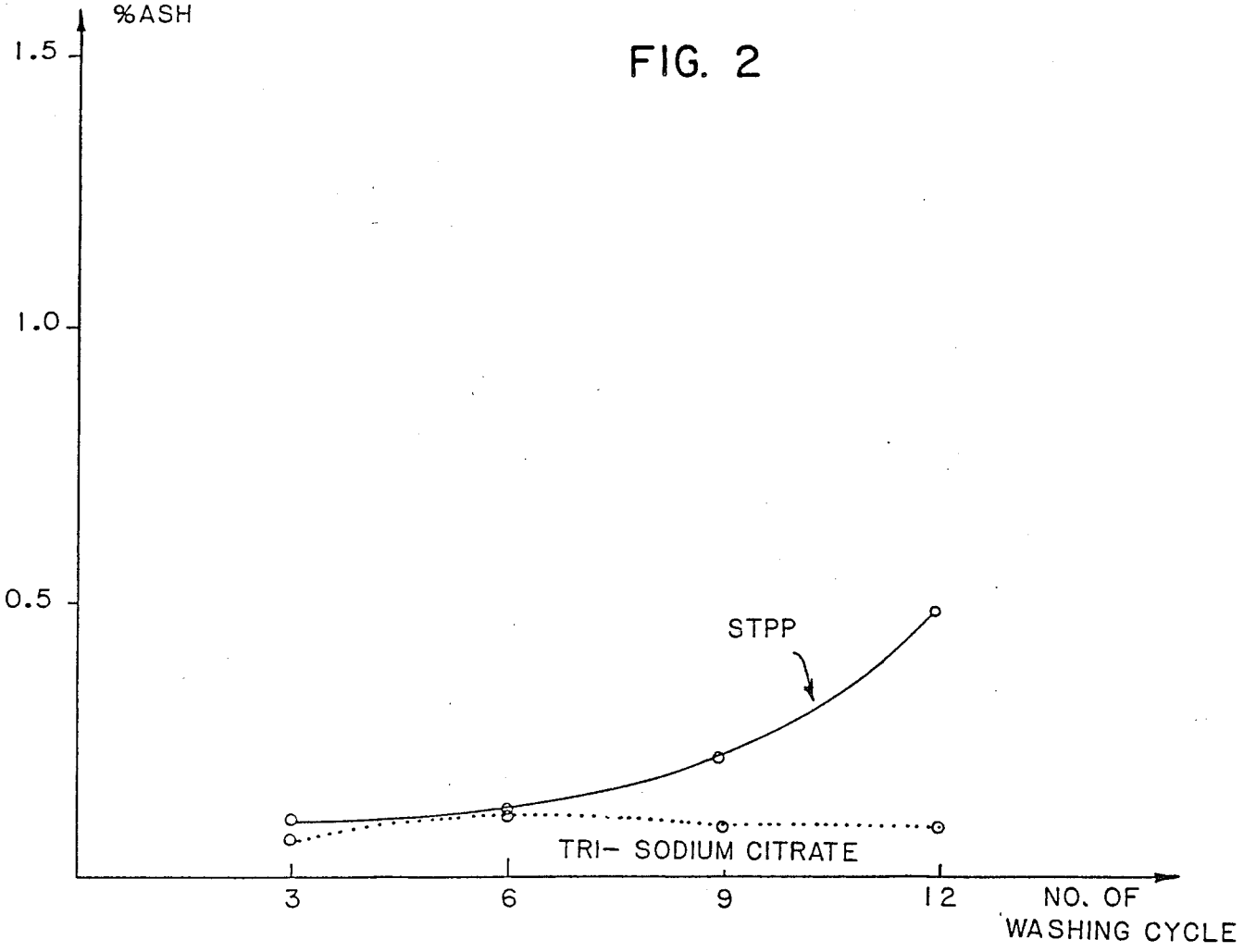

The results of encrustation buildup obtained is reported in the graph illustrated in the FIG. 2 drawing. As far as the encrustation buildup is concerned, no buildup was observed with the sodium tripolyphosphate detergent builder salt.

It is understood that the foregoing detailed description is given merely by way of illustration and that variations may be made therein without departing from the spirit of the invention.

What is claimed is:

1. A unitary laundry detergent product for use in an automatic laundry washing machine comprising a sachet comprising an outer package of a water-permeable water-insoluble plastic film or textile fabric, an inner package within said outer package, said inner package formed from a water-soluble polymer film, and sealed within said inner package an amount of from about 50 to about 150 grams of a non-aqueous liquid fabric treating composition which comprises, based on the total composition, on a weight basis, from about 20% to about 70% of liquid nonionic surfactant detergent, from about 20% to about 60% of alkali metal hydroxy polycarboxylic acid salt having from 4 to 8 carbon atoms, and from about 0.5 to 20% of a lower alkylene glycol alkyl ether solvent, in amount sufficient to lower the viscosity and gelling temperature of the composition such that the composition remains pourable at temperatures at least as low as 5° C.

2. The laundry detergent product of claim 1 wherein the inner package is formed from hydrolyzed polyvinyl acetate and the outer package comprises a non-woven textile fabric.

3. The laundry detergent product of claim 2 wherein the non-woven textile fabric comprises polyester fibers.

4. The laundry detergent product of claim 2 wherein the non-woven textile fabric comprises spun-bonded polypropylene.

5. The laundry detergent product of claim 1 wherein the inner package is freely floating within the outer package.

6. The laundry detergent product of claim 1 which further comprises a removable outermost waterproof wrapper enclosing said sachet.

7. The laundry detergent product of claim 6 wherein said outermost waterproof wrapper comprises polyvinylidene chloride.

8. The laundry detergent product of claim 1 wherein said fabric treating composition further comprises one or more detergent adjuvants selected from sequestering and anti-encrustation agents, alkali metal silicates, bleaching agents, bleach activators, antiredeposition agents, optical brighteners, enzymes, perfume, detergent builder salts, and coloring agents, the total amount of suspended particles in said composition being no more than about 55%.

9. The laundry detergent product of claim 1 wherein the liquid nonionic surfactant comprises a fatty alcohol having from about 10 to about 22 carbon atoms condensed with from about 5 to 30 moles ethylene oxide, propylene oxide or mixtures thereof.

10. The laundry detergent product of claim 1 wherein the hydroxy polycarboxylic acid builder salt comprises from 1 to 4 hydroxyl groups and from 2 to 3 carboxyl groups per molecule.

11. The laundry detergent product of claim 1 wherein the hydroxy polycarboxylic acid builder salt is an alkali metal citrate or tartrate.

12. The laundry detergent product of claim 1 wherein said liquid fabric treating composition has a viscosity at 25° C, of no more than 6000 centipoises.

13. The laundry detergent product of claim 1 wherein said liquid fabric treating composition has a viscosity at 25° C., of no more than 5000 centipoises.

14. The laundry detergent product of claim 1 wherein said liquid fabric treating composition is a low- or no-phosphate liquid non-aqueous laundry detergent composition which is pourable at a temperature of 5° C, and which comprises, on a weight basis, from about 25 to 45% of liquid nonionic detergent compound comprising condensation product of from about 12 to about 20 carbon atoms condensed with from 7 to 20 moles ethylene oxide, propylene oxide or mixtures thereof, from about 20 to 45% of alkali metal salt of citric acid or tartaric acid, from about 5 to 15% of alkylene glycol alkyl ether solvent as a viscosity reducing and gel inhibiting agent, from about 5 to 15% of peroxy compound bleaching agent, from 0 to 10% of activator for said bleaching agent, from 0 to 10% in total of one or more additional detergent adjuvant selected from antiencrustation agents, sequestering agents, antiredeposition agents, optical brighteners, enzymes, perfumes, and coloring agents.

15. The laundry detergent product of claim 1 wherein said liquid non-aqueous fabric treating composition comprises from about 30 to about 46% of a liquid nonionic surfactant which is a mixed ethylene oxide - propylene oxide condensate of a fatty alcohol having from about 12 to about 18 carbon atoms;

from about 25 to about 37% of sodium citrate detergent builder salt;

from about 8 to about 12.5% of an tripropylene glycol methyl ether as a viscosity control and antigelling agent;

from about 9 to about 13.5% of a peroxide bleaching agent;

from about 3.5 to about 5.5% of a bleach activator;

up to about 2% of enzymes;

up to about 10% of soil suspending, antiredeposition and antiyellowing agents;

up to about 5% of high complexing power sequestering agent; and up to about 2% each of one or more of colorants, perfumes and optical brighteners.

16. The laundry detergent product of claim 1 wherein the inner package is attached to one or more edges or walls of the outer package.

17. A unitary laundry detergent product for use in an automatic laundry washing machine comprising a multicomponent sachet comprising an outer package of water-permeable water-insoluble material, an inner package within said outer package and formed from water-soluble liquid impermeable material, and sealed within said inner package a unitary dosage of a non-aqueous liquid cleaning composition, and a removable outermost waterproof wrapper enclosing the multicomponent sachet, said non-aqueous liquid cleaning composition comprising nonionic liquid surfactant, fabric treating solid particles suspended in the non-aqueous liquid, alkylene glycol monoalkyl ether solvent in amount sufficient to lower the viscosity and gel point of the composition, wherein at least 50% by weight of the fabric treating solid particles are comprised of an alkali metal salt of a mono- or polyhydroxy polycarboxylic acid of from 4 to 8 carbon atoms as detergent builder.

18. The laundry detergent product of claim 17 wherein the non-aqueous liquid cleaning composition comprises from about 45 to 75% of liquid phase and from about 55 to 25% of suspended solid particles.

* * * * *